US007017467B1

(12) United States Patent
Monroe

(10) Patent No.: US 7,017,467 B1
(45) **Date of Patent: *Mar. 28, 2006**

(54) GUIDED MISSILE DEFENSE METHOD AND APPARATUS

(75) Inventor: John N. Monroe, Santa Monica, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 04/520,820

(22) Filed: Dec. 20, 1965

(51) Int. Cl.
*E41F 3/04* (2006.01)

(52) U.S. Cl. ..... 89/1.816

(58) Field of Classification Search ..... 331/94.5; 372/22, 23; 89/1.816, 1.819; 356/139.08
See application file for complete search history.

(56) References Cited

U.S. PATENT DOCUMENTS 5,600,434 A * 2/1997 Warm et al. ..... 356/139.08
6,587,486 B1 * 7/2003 Sepp et al. ..... 372/22

FOREIGN PATENT DOCUMENTS

| | | | |
|---|---|---|---|
| GB | 1514457 | * | 6/1978 |
| GB | 2193855 | * | 2/1988 |
| JP | 518699 | * | 1/1993 |

* cited by examiner

*Primary Examiner*—Nelson Moskowitz
(74) *Attorney, Agent, or Firm*—Sidley Austin Brown & Wood LLP; Stephen S. Sadacca

(57) ABSTRACT

A method of defense against optically guided missiles, said method comprising the steps of:

mounting a single-ended laser adjacent the area to be protected emitting electromagnetic radiation at a frequency within the sensitive frequency range of said guided missile, directing said radiation toward an area within which said radiation may be reflected by components of said missile, causing lasing operation of said laser in response to reflection of said radiation by components of said missile, and modulating the output of said laser in response to said lasing operation for misdirecting said guided missile.

5 Claims, 2 Drawing Sheets

GUIDED MISSILE DEFENSE METHOD AND APPARATUS

This invention relates to methods and apparatus for guided missile defense and is particularly directed to counter-measure methods and apparatus for providing defense against guided missiles employing optically sensitive guidance systems.

In recent years, guided missiles have been developed employing guidance systems which are designed to locate and track a target optically. Thus, for example, anti-aircraft missiles have been developed which can locate and track jet aircraft by sensing infra-red radiation emitted both from the exhaust of the jet engine and from the heat of the aft portion of the jet engine. Since the velocity of the anti-aircraft missile is greater than manned aircraft, such missiles have been effective antiaircraft weapons.

Heretofore, no effective counter-measure has been developed to protect the aircraft against such missiles. However, in accordance with the present invention, a method and apparatus are proposed whereby the guidance systems of such missiles can be confused so as to direct the missile away from the aircraft. Moreover, the apparatus of the present invention is simple, compact, and light in weight. Moreover, once installed, the apparatus of the present invention is completely automatic and does not require aiming or triggering. In addition, the apparatus could readily be installed on existing aircraft without requiring extensive modification of the aircraft.

The advantages of the present invention are preferably attained by providing a single-ended laser comprising an elongated body of excitable material, a retro-directive member located adjacent to one end of said body of material substantially in optical alignment with the axis of said body of material, and means for exciting said body of material. The laser is mounted to direct a radiation generally aft of the aircraft. It has been found that certain components, commonly used in optical guidance systems, are reflective and will cooperate with the apparatus of the present invention to cause the laser to function. Thus, a laser beam is formed between the optical guidance system in the anti-aircraft missile and the retro-directive member located adjacent to the said body of lasing material. Means are provided to detect this lasing beam and to modulate the beam to confuse and misdirect a missile which is attempting to track and destroy the aircraft.

Accordingly, it is an object of the present invention to provide a method and apparatus for defending against optically guided missiles.

Another object of the present invention is to provide apparatus for defending aircraft against optically guided missiles, which apparatus can be carried by the aircraft and can be installed on existing aircraft without requiring extensive modification of the aircraft.

A further object of the present invention is to provide apparatus for defending aircraft against optically guided missiles, which apparatus is completely automatic and, after installation, does not require aiming or triggering.

A specific object of the present invention is to provide a method and apparatus for defending against optically guided missiles by mounting a laser, adjacent an area to be protected, emitting electromagnetic radiation at a frequency within the sensitive frequency range of the optical guidance system of the said missile to cause said laser to lase in response to reflection of the emitted radiation by components of the guidance system of said missile, and modulating said laser beam to misdirect said missile.

These and other objects and features of the present invention will be apparent from the following detailed description taken with reference to the figures of the accompanying drawings.

IN THE DRAWINGS

Figure 1:
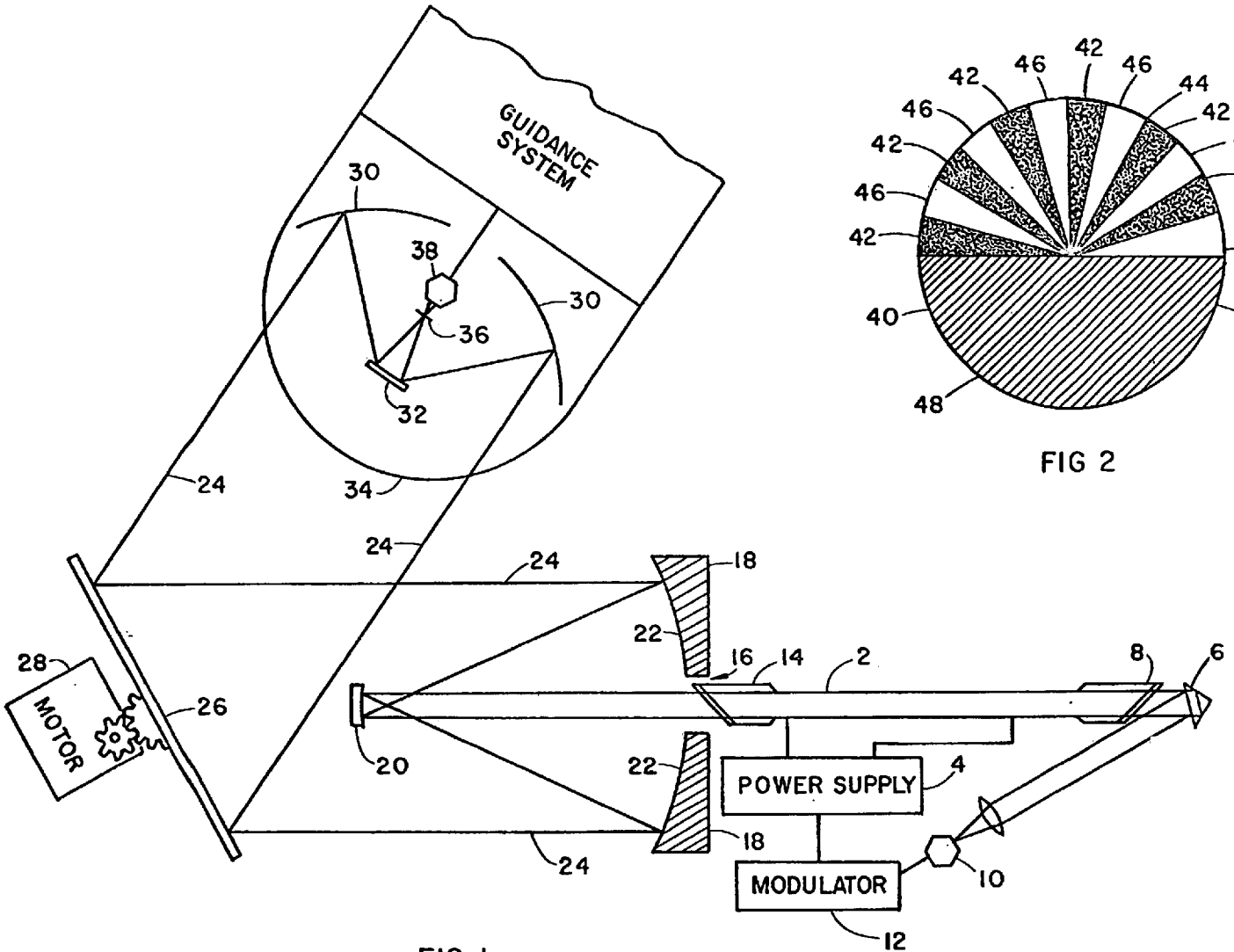
FIG. 1 is a diagrammatic representation of a missile defense system embodying the present invention.

In the form of the present invention chosen for purposes of illustration in the drawings, FIG. 1 shows a gas laser 2 which can be excited by a radio frequency source 4. A retro-directive member 6, such as a cube corner reflector having a partially reflective planar front surface, is positioned adjacent to one end 8 of the laser 2 and is substantially in optical alignment with the axis of the laser 2. The optical system formed by laser 2 and retro-directive member 6 may be referred to as a "single-ended laser" and such systems are shown and described in the copending application of John N. Monroe, Ser. No. 520,821 filed 20 Dec. 1965, and entitled "Laser Method and Apparatus." As seen in FIG. 1, reflective member 6 is slightly canted so as to direct some of the light from the laser 2 to a photosensitive detector 10. Detector 10 detects lasing operation of the laser 2 and supplies electrical signals to a modulator circuit 12 which controls source 4 to regulate the operation of the laser 2. The modulator circuit 12 may, for example, consist of a conventional square-wave generator triggered by the output of a delay line. Adjacent the opposite end 14 of laser 2, light from the laser 2 passes through an opening 16 in the center of a parabolic mirror 18 and is reflected by a small mirror 20 to the reflective surface 22 of the parabolic mirror 18. From the reflective surface 22, the light is directed in a path 24 to a plane mirror 26, which may be rotated by a suitable motor 28 to cause the path 24 to scan substantially any desired angle.

The apparatus, described above, constitutes the defense system of the present invention and, as hereinafter described, interacts with components of optical guidance systems to detect the approach of a guided missile and to provide signals which will mislead the guidance system to misdirect the missile. Moreover, this apparatus can be made quite compact and light in weight, so as to permit such apparatus to be carried by aircraft and can be installed on existing aircraft without requiring extensive revision of the aircraft.

Figure 2:
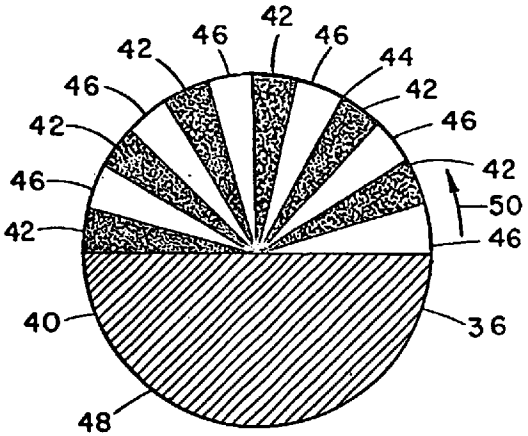
FIG. 2 is a front view of the reticle of a typical optical guidance system for missiles.
Figure 3:
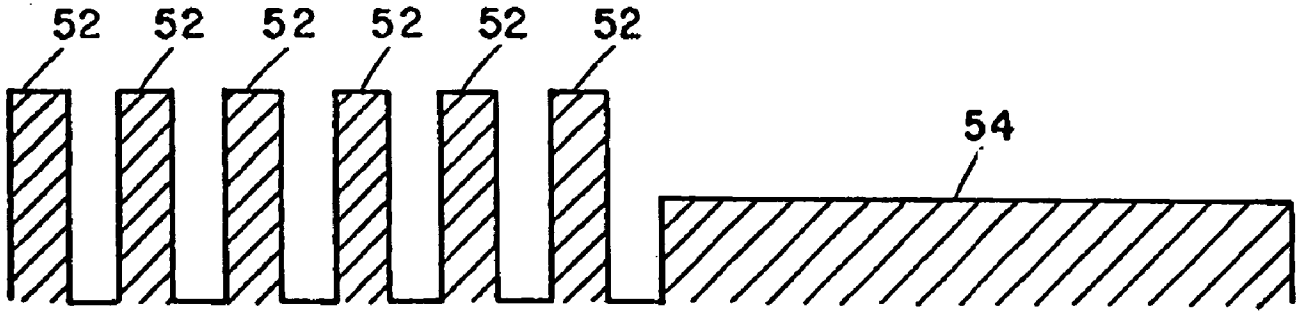
FIG. 3 is a diagrammatic representation of the signal normally generated by the passage of radiation through the reticle of FIG. 2.

Optical guidance systems generally include a light gathering system, such as mirrors 30 and 32 of FIG. 1, enclosed within a transparent shield 34. The mirrors 30 and 32 cause incident light, such as that within path 24, to pass through a reticle 35 to a photosensitive detector 38 which supplies signals that are employed by suitable means, not shown,to steer the missile. As best seen in FIG. 2, the reticle 36 is generally formed as a circular disc 40 having a plurality of opaque sectors 42 disposed about one half 44 of the disc 40 and spaced from each other by a plurality of transparent sectors 46. The opposite half 48 of the disc 40 is partially transparent so as to pass light at lesser intensity than that passed by the transparent sectors 46. The reticle 36 is rotated, as indicated by arrow 50, by suitable means, not shown; so that light falling on the detector 38 will produce signals, as indicated in FIG. 3, which are coded so as to provide steering information to the guidance system. Light passing through the transparent sectors 46 of disc 40 produces the short duration, high intensity pulses, seen at 52 in FIG. 3, while light passing through the partially transparent area 48 of disc 40 produces the long duration, low intensity signal 54. Within the circuitry of the guidance system, the intensity of the pulses 52 is compared with that of signal 54 to derive information for steering the missile. Thus, in anti-aircraft missiles, the infra-red light emitted by the engine exhaust of a target aircraft is detected by the optical guidance system to permit the missile to track and destroy the aircraft. However, it is important to note that the opaque sectors 42 and partially transparent portion 48 of reticle 36 will inherently be reflective to some extent.

Figure 4:
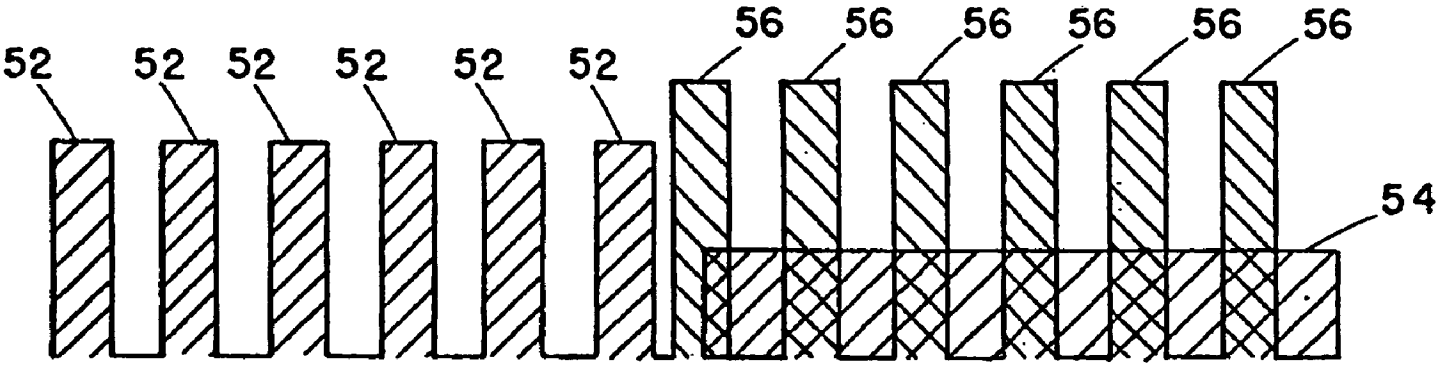
FIG. 4 is a diagrammatic representation of the signal passed by the reticle of FIG. 2 due to the defense system of FIG. 1.

To accomplish this, the laser 2 is designed to emit infra-red light at a frequency within the range of frequencies occurring in the exhaust of the aircraft engine. As is well known, lasing operation can only occur when the light emitted by the laser is reflected to re-pass through the laser. With the apparatus of FIG. 1, the light emitted from end 14 of laser 2 will not normally be reflected. Consequently, lasing operation will not take place. However, should an optically guided missile attempt to track the aircraft, it has been found that light, such as that in path 24, emitted by laser 2 will be reflected by the opaque sectors 42 of the reticle 36 of the missile's guidance system and, to a lesser extent by partially transparent portion 48. This reflected light will be returned along path 24 and will-be reflected by mirrors 18 and 20 to re-pass through laser 2 to reflector 6. For "stand by" operation, radio frequency source 4 is caused to maintain laser 2 at an excitation level slightly below the threshold for lasing operation. However, the additional energy supplied by the light reflected from the opaque sectors 42 and portion 48 of the reticle 36 of the missile's guidance system will be sufficient to initiate lasing operation within the laser 2. As indicated above, corner reflector 6 is canted slightly so that some of the light from the lasing operation of laser 2 will be directed to detector 10, causing detector 10 to supply a signal to modulator circuit 12 which will be substantially identical with the signal, shown in FIG. 3, passed by reticle 36 to the guidance system of the missile. The modulator circuit 12 responds to this signal by causing radio frequency source 4 to pulse laser 2 in an appropriate manner to cause lasing operation, during the interval of signal 54 of FIG. 3, but at an intensity greater than that of pulses 52 and at a repetition rate corresponding to that of the pulses 52. These pulses will be passed by the partially transparent portion 48 of the missile's reticle 36 and will cause detector 38 of the missile to supply a signal, as shown in FIG. 4, to the guidance system of the missile. Since the laser induced pulses, seen at 56 in FIG. 4, are of greater intensity than the pulses 54, these pulses 56 will be supplied to the missile's steering mechanism and will cause a tracking error. This will cause the missile to steer away from the target and, once the missile is turned from the target, the optical guidance system will be unable to "see" the exhaust of the target aircraft and the danger to the target aircraft will be eliminated. It will be seen, from the foregoing description, that the apparatus of the present invention is completely automatic and, once installed, does not require aiming and is self-triggering.

Obviously, numerous variations and modifications may be made without departing from the present invention. Accordingly, it should be clearly understood that the form of the present invention described above and shown in the figures of the accompanying drawings is illustrative only and is not intended to limit the scope of the present invention.

What is claimed is:

1. A method of defense against optically guided missiles, said method comprising the steps of:

mounting a single-ended laser adjacent the area to be protected emitting electromagnetic radiation at a frequency within the sensitive frequency range of said guided missile, directing said radiation toward an area within which said radiation may be reflected by components of said missile, causing lasing operation of said laser in response to reflection of said radiation by components of said missile, and modulating the output of said laser in response to said lasing operation for misdirecting said guided missile.

2. A method of defending jet aircraft against optically guided missiles, said method comprising the steps of:

mounting a single-ended laser adjacent the exhaust of said aircraft, exciting said laser to emit infra-red radiation, directing said radiation toward an area within which said radiation may be reflected by components of said missile, causing lasing operation of said laser in response to reflection of said radiation by components of said missile, and modulating the output of said laser in response to said lasing operation for misdirecting said missile.

3. Apparatus for defending against optically guided missiles, said apparatus comprising:

a single-ended laser emitting electromagnetic radiation at a frequency within the frequency range detectable by said missile, means directing said radiation in a direction to be reflected by an approaching missile in a manner to re-pass through said laser, and means for modulating the output of said laser in response to lasing operation of said laser for misleading said guided missile.

4. Apparatus for defending against optically guided missiles, said apparatus comprising:

a single-ended laser emitting radiation at a frequency within the frequency range detectable by said missile, means causing said radiation to scan a predetermined area in a manner such that said radiation will be reflected by a missile within said area and will re-pass through said laser, and means for modulating the output of said laser in response to lasing operation of said laser for misleading said guided missile.

5. Apparatus for defending against optically guided missiles, said apparatus comprising:

a single-ended laser emitting radiation at a frequency within the frequency range detectable by said missile, means directing said radiation in a direction to be reflected by an approaching missile in a manner to re-pass through said laser, and means responsive to occurrence of lasing operation of said laser during a first time interval to cause additional lasing operation of said laser during a second time interval for misleading said guided missile.

* * * * *